United States Patent [19]

Kingsbury

[11] 4,171,660

[45] Oct. 23, 1979

[54] BRIDGE OR TAILPIECE FOR MUSICAL INSTRUMENT

[76] Inventor: Lyle H. Kingsbury, 1010 N. 31st, Boise, Id. 83702

[21] Appl. No.: 798,993

[22] Filed: May 20, 1977

[51] Int. Cl.[2] ..... G10D 3/12

[52] U.S. Cl. ..... 84/297 R; 84/299

[58] Field of Search ..... 84/267, 290, 297 R, 84/298-302

[56] References Cited

U.S. PATENT DOCUMENTS

| | | | |
|---|---|---|---|
| 1,462,359 | 7/1923 | Winship et al. | 84/300 |
| 3,096,676 | 7/1963 | Havivi et al. | 84/302 |

FOREIGN PATENT DOCUMENTS

| | | | |
|---|---|---|---|
| 908936 | 4/1954 | Fed. Rep. of Germany | 84/302 |

*Primary Examiner*—Lawrence R. Franklin

*Attorney, Agent, or Firm*—Charles L. Kraft, II

[57] ABSTRACT

The bridge or tailpiece is fastened to the butt end of the sounding box of a stringed instrument, with a portion thereof projecting above the uppermost surface of the box, and with strings of the instrument being secured to the elevated portion. The tailpiece is adjustable for height relative to the upper surface of the box. The tailpiece may include adaptations which secure the strings at various levels above the box.

7 Claims, 5 Drawing Figures

BRIDGE OR TAILPIECE FOR MUSICAL INSTRUMENT

FIELD OF THE INVENTION

The present invention relates to guitars and similar stringed instruments, and more particularly to bridges and tailpieces therefor.

BRIEF DESCRIPTION OF THE PRIOR ART

Bridge and tailpiece combinations of the prior art typically have been so structured as to transmit tension from the strings to the upper center of the sound box, resulting in deformation of the box and distortion of sound. Further, an important resonance quality is produced by transmission of sound through the tailpiece to the sound box; tailpieces of the prior art tend to lack structure which is sensitive to the strings or transmits sound accurately to the box.

Accordingly, it is an object of the present invention to provide an improved tailpiece which may better sense and transmit sounds from the strings to the sound box, and which improves the capacity of the strings to hold tones and sounds.

It is a further object of the present invention to provide a tailpiece which is adjustable with respect to its cooperation with the bridge, and with respect to the depth of tone produced.

These and other objects shall become apparent from the description following, it being understood that modifications may be made without affecting the teachings of the inventions here set out.

SUMMARY OF THE INVENTION

The bridge or tailpiece is fastened to the butt end of the sounding box of a stringed instrument, with a portion thereof projecting above the uppermost surface of the box, and with strings of the instrument being secured to the elevated portion. The tailpiece is adjustable for height relative to the upper surface of the box. The tailpiece may include adaptations which secure the strings at various levels above the box.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
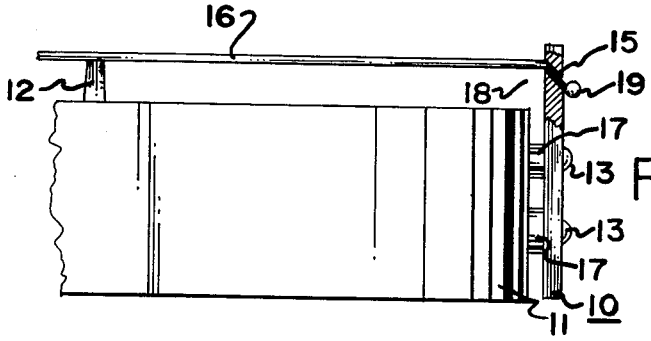
FIG. 1 is a fragmentary side elevational view of the tailpiece of the present invention shown in the environment of of a guitar.
Figure 2:
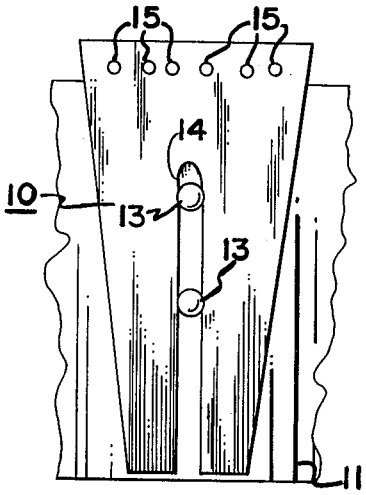
FIG. 2 is an end elevational view of the tailpiece of FIG. 1 and shown from the butt end of the guitar.

Referring now to the drawings and more particularly to the FIGS. 1 and 2, the tailpiece of this invention is shown to advantage and generally identified by the numeral 10. The tailpiece 10 may be mounted to any of a variety of stringed instruments such as a guitar 11. The present tailpiece may be employed with a bridge 12 of the type described in my U.S. Pat. No. 3,896,695.

The tailpiece 10 is a rigid plate-like member which is fastened to the butt of the guitar 11 by fasteners 13 which penetrate the framing member (not shown) of the guitar 11. The fasteners 13 are disposed through a slot 14 provided in the lower portion of the tailpiece 10, adjacent the butt of the guitar 11. The uppermost edge of the tailpiece 10 is provided with a multiplicity of holes 15 which correspond to and retain the strings 16 of the guitar 11. The row of holes 15 projects by a predetermined distance above the upper edge of the guitar 11.

In the embodiment of FIG. 2 the relative altitude of the strings 16 above the upper surface of the guitar 11 at the tailpiece 10 is substantially lower than the bridge 12. The structure results in greater depth of tone from the longer of the strings 16.

As shown more clearly in FIG. 1, depth of tone may be increased further by providing spacers 17 having predetermined resonant qualities. The tailpiece 10 may also include a string saddle 18 over which the strings 16 must pass to the holes 15. Furthermore, the holes 15 may be provided subjacently of the saddle 18. The latter may be accomplished by boring the holes 15 at an angle of approximately 45°. The terminal end of the string 16 is provided with a ball 19 which abuts the tailpiece 10 at each hole 15. Each string 16 is thus held taut to the saddle 18 for maximum resonant benefit.

Figure 3:
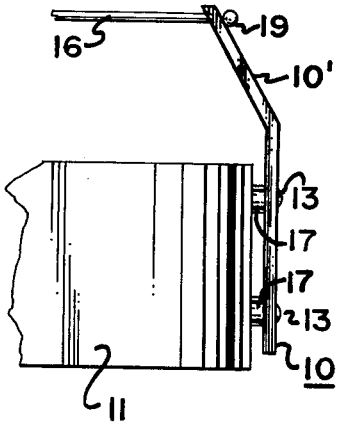
FIG. 3 is a side elevational view of a further embodiment of the tailpiece.

Referring now to the FIG. 3, a further embodiment of the tailpiece 10 includes a canted or bent upper portion 10' which inclines over the upper surface of the guitar 11, in the direction of the neck (not shown). This structure shortens the critical length of the strings 16 between the bridge 12 (if any) and the butt of the guitar 11. The resultant tonal quality is again deepened, and spurious undertones of the sections of the strings 16 between the bridge 12 and the butt is substantially reduced.

Figure 4:
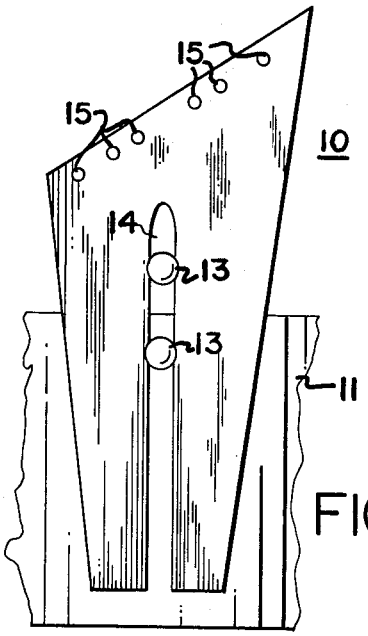
FIG. 4 is an end elevational view of still another embodiment of the tailpiece.

Referring to FIG. 4, the tailpiece 10 may include a plurality of holes 15 which are arranged in a row inclined with respect to the upper surface of the guitar 11. It is intended that the holes 15 relatively closer to the upper surface of the guitar 10 connect to succeedingly lower notes or strings 16, while treble notes connect to higher holes 15. This configuration tends to optimize the requirements of loudness, sustaining capacity, and resonance alluded to above.

Figure 5:
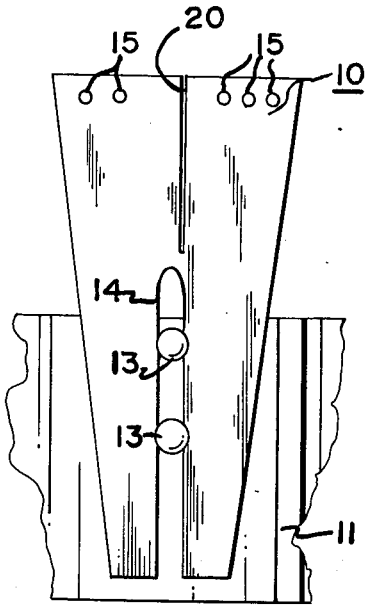
FIG. 5 is an end elevational view of another embodiment of the present tailpiece.

As shown in the FIG. 5, a still further embodiment of the tailpiece 10 includes a centrally disposed vertical slot 20 which is cut downwardly from the uppermost terminal edge of the tailpiece 10. The slot 20 may be disposed in the tailpiece 10 to separate treble and bass strings 16. This structure increases loudness and the capacity to sustain tones. As above the latter embodiment may be provided with the canted portion 10' and the saddle 18 (both not shown in FIG. 5).

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A tailpiece for a stringed instrument having a sounding box and a plurality of strings, comprising:

a plate-like member secured to the butt end of said sounding box; and a plurality of means securing terminal ends of said strings to said plate, said means being disposed along the uppermost terminal edge of said plate, said terminal edge being disposed a selected distance above the upper surface of said sounding box, said tailpiece including spacers of preselected resonance being disposed between said tailpiece and said box.

2. The apparatus of claim 1 including a vertically oriented slot disposed centrally in said plate-like member, and selectively secureable fasteners disposed through said slot into said sounding box by which said uppermost edge of said tailpiece may be adjusted.

3. The apparatus of claim 1 wherein the upper portion of said plate-like member is canted over the upper surface of said box.

4. The apparatus of claim 1 wherein said means securing said strings are a multiplicity of holes, said holes being bored at an inclined angle to the upper surface of said box.

5. The apparatus of claim 4 wherein said angle of inclination of said holes is approximately forty-five degrees.

6. The apparatus of claim 1 wherein said means securing said strings are a multiplicity of holes disposed in an inclined row in the upper portion of said plate-like member.

7. The apparatus of claim 1 wherein said plate-like member includes a vertically disposed slot cut from the uppermost terminal edge.

* * * * *